US005278035A

United States Patent [19]

Knapp

[11] Patent Number: 5,278,035

[45] Date of Patent: Jan. 11, 1994

[54] NON-TOXIC PHOTOGRAPHIC DEVELOPER COMPOSITION FOR PROCESSING X-RAY FILMS IN AUTOMATIC FILM PROCESSORS

[76] Inventor: Audenried W. Knapp, 225 Larch Rd., Frankfort, Ill. 60423

[21] Appl. No.: 684,192

[22] Filed: Apr. 12, 1991

Related U.S. Application Data

[63] Continuation-in-part of Ser. No. 551,078, Jun. 11, 1990, abandoned, which is a continuation-in-part of Ser. No. 472,803, Jan. 30, 1990, abandoned.

[51] Int. Cl.[5] ..... G03C 5/305

[52] U.S. Cl. ..... 430/452; 430/436; 430/441; 430/451; 430/464; 430/478; 430/486

[58] Field of Search ..... 430/419, 426, 451, 452, 430/464, 478, 484, 489, 491, 966, 436, 441, 486

[56] References Cited

U.S. PATENT DOCUMENTS

| | | | |
|---|---|---|---|
| Re. 26,601 | 6/1969 | Allen et al. | 430/452 |
| 2,688,549 | 9/1954 | James et al. | 430/480 |
| 3,658,527 | 4/1972 | Kunz et al. | 430/234 |
| 4,155,763 | 5/1979 | Hasebe et al. | 430/363 |
| 4,279,987 | 7/1981 | Ogi et al. | 430/547 |

*Primary Examiner*—Hoa Van Le

[57] ABSTRACT

A non-hydroquinone and non-alkali metal hydroxide containing developer composition for radiographic materials and a method of use thereof are provided. The developer composition comprises a developer selected from the group consisting of ascorbic acid and sugar-type derivatives thereof, stereoisomers and diastereoisomers of ascorbic acid and its sugar-type derivatives, their salts and mixtures thereof, together with a sulfite, a 3-pyrazolidone compound, and an anti-swelling agent selected from the group consisting of sodium sulfate, glutaraldehyde or mixtures thereof, said composition having a pH of from 9.5 to 10.6, and said developer being present in an amount of at least about 15 grams, said sulfite being present in an amount of from 2 to 50 grams, said swelling control agent being present in an amount of from 35 to 90 grams, and water to 1.0 liter.

31 Claims, No Drawings

NON-TOXIC PHOTOGRAPHIC DEVELOPER COMPOSITION FOR PROCESSING X-RAY FILMS IN AUTOMATIC FILM PROCESSORS

CROSS REFERENCE TO RELATED APPLICATION

This application is a continuation-in-part of U.S. patent application Ser. No. 07/551,078, filed Jun. 11, 1990, now abandoned, which is a continuation-in-part application of U.S. patent application Ser. No. 07/472,803, filed on Jan. 30, 1990; now abandoned.

BACKGROUND OF THE PRESENT INVENTION

The present invention is directed to a photographic developer composition for processing radiographic silver halide emulsions in automatic film processors, which does not contain any toxic chemicals (as deemed advisable by the Occupational Safety and Health Act) and does not contain any substances deemed hazardous to the environment under Title III of the Superfund Amendments and Reauthorization Act of 1986 (SARA), Sections 302, 304, and 313.

Photographic developer compositions for radiographic materials are well-known in the art. The processing of silver halide photographic materials is performed by a multiple step sequence consisting of developing, fixing, washing and drying steps. The development step is conventionally undertaken with an aqueous alkaline developer composition containing hydroquinone as a developing agent either singly or with one or more additional developing agents.

More specifically, the exposure of a silver halide emulsion to radiation to which the emulsion is sensitized produces a latent image in the silver halide grains of the emulsion. The latent image is developed by immersion of the exposed emulsion into an aqueous developing solution which contains a reducing (developing) agent. The hydroquinone or other suitable developing agent serves to reduce the exposed silver halide grains to yield the developed photographic image.

In radiographic applications, the materials normally have a silver halide emulsion on both sides, which presents specific problems when these materials are developed in automatic, roller-type processors. The higher heat of development (customarily 90° to 95° F.) softens these emulsions, making them very susceptible to being scratched during development and transport between tanks. In addition, the softened emulsions absorb additional moisture as they become swollen, making it very difficult to remove enough moisture to adequately dry the film before it exits from the processor. For this reason many hardening agents have been explored for inclusion in the developer composition to reduce swelling (softening) of the emulsion during development. In practice, an aldehyde such as formaldehyde or glutaraldehyde or a bisulfite adduct of these is commonly used. The preferred compound is glutaraldehyde which hardens better in the presence of sulfite (which is normally included in a developer composition as a preservative for developing agents) than formaldehyde (see, Photographic Processing Chemistry, L. F. A. Mason, 1966, p. 154).

While hydroquinone-based developer compositions containing a dialdehyde have been employed with success for many years, more recently the use of such compositions has met with some doubt due to the toxicity and hazardous impact on the environment of hydroquinone, caustic alkalies, and dialdehydes such as glutaraldehyde. That is, due to the toxic nature of various components employed in conventional radiographic developer compositions, it is necessary to meet various guidelines and regulations promulgated to protect either the health of those who are exposed to such compositions or to protect the environment into which such compositions are exposed. As three of the least desirable components generally present in conventional radiographic developer compositions are hydroquinone, caustic alkalies, and glutaraldehyde, it would thus be desirable to discover acceptable substitutes which are less toxic by nature.

It is also important to maintain the pH of the developer composition within strict alkaline ranges to ensure satisfactory and consistent operation of the composition. For this purpose, caustic alkalies (caustic soda or caustic potash) are normally employed in the developer composition.

Exemplary hydroquinone-based developer compositions are disclosed in, for example, U.S. Pat. Nos. 2,893,865; 3,733,199; 3,865,591; 4,046,571; 4,205,124; 4,756,990; and 4,816,384.

OBJECTS AND SUMMARY OF THE PRESENT INVENTION

It is thus one object of the present invention to provide a developer composition which does not require the presence of hydroquinone-type developer components.

It is also an object of the present invention to provide a developer composition which does not require the presence of caustic alkali components to ensure the proper pH for the developer composition.

It is also an object of the present invention to provide a developer composition that may contain a substitute for an aldehyde hardening agent to reduce swelling of the emulsion during development.

It is further an object of the present invention to provide a developer composition which is comprised of components which are substantially less toxic by nature and which may be safely disposed of without fear of contamination of the environment.

In accordance with the present invention, there is thus provided a non-hydroquinone containing photographic developer composition for radiographic materials comprising a developer selected from the group consisting of ascorbic acid and sugar-type derivatives thereof, stereoisomers and diastereoisomers of ascorbic acid and its sugar-type derivatives, their salts and mixtures thereof, a 3-pyrazolidone compound together with sodium sulfate and/or glutaraldehyde, said composition having a pH of from 9.5 to 10.6.

In accordance with yet another embodiment of the present invention, there is provided a non-hydroquinone containing developer composition comprising a developer comprising erythorbic acid and at least one salt thereof, and sodium sulfate and/or glutaraldehyde.

In accordance with yet another embodiment of the present invention, there is provided a non-hydroquinone containing developer composition comprising a developer comprising at least one salt of ascorbic and erythorbic acid, and sodium sulfate and/or glutaraldehyde.

DETAILED DESCRIPTION OF THE PRESENT INVENTION

The present invention pertains to a non-hydroquinone-containing radiographic developer composition which requires neither a toxic hydroquinone-type developing agent, nor a caustic alkali pH control agent. Instead, it has been found that such components can be replaced with success with substantially non-toxic components.

Specifically, it has been found that in lieu of the toxic developing agents of prior art, a developing agent may be employed selected from the group consisting of ascorbic acid and sugar type derivatives thereof, stereoisomers and diastereoisomers of ascorbic acid and its sugar-type derivatives, their salts and mixtures thereof, and an inert salt, such as sodium sulfate.

Such developers are discussed at length in U.S. Pat. Nos. 2,688,549 (James et al) and 3,942,985 (Newman et al), the substance of each patent being incorporated by reference in its entirety with regard to such discussion.

Suitable developers which fall within the scope of the above include but are not limited to ascorbic acid, d-erythro-ascorbic acid (i.e., erythorbic or isoascorbic acid), d-glucosascorbic acid, 6-deoxy-1-ascorbic acid, 1-rhamnoascorbic acid, 1-fucoascorbic acid, d-glucoheptoascorbic acid, sorboascorbic acid, ω-lactoascorbic acid, maltoascorbic acid, 1-araboascorbic acid, 1-glucoascorbic acid, d-galactoascorbic acid, 1-guloascorbic acid, and 1-alloascorbic acid.

Exemplary salts of such developers include alkali metal salts, such as the sodium and potassium salts thereof (e.g., sodium or potassium ascorbate and sodium or potassium erythorbate).

The unsubstituted compounds of this class of compounds may be represented by the formula:

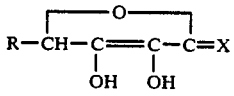

wherein X is an oxygen atom or imino group, R is any group which does not render the ascorbic acid water-insoluble and is a non-interfering group. Non-interfering is defined as not causing stearic hindrance, is not chemically reactive with other portions of the molecule, is not a coordinating group for the molecule, and is not more electropositive than a saturated hydrocarbon residue. R is preferably an aryl group or a group of the formula $R_1CH_2(CHOH)_{n-1}$- wherein n is a positive integer from 1 to 4 and $R_1$ is either a hydrogen atom or hydroxyl group when n is 2 to 4 and is hydroxyl when n is 1. Of these materials, ascorbic and erythorbic (isoascorbic) acid are preferred.

Representative developers identified above have the following structure:

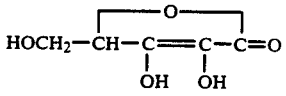

(1-erythro-ascorbic acid)

-continued

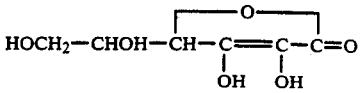

(1-ascorbic acid)

However, the prior art, while disclosing the use of ascorbic acid and certain of its derivatives or isomers in developer compositions, fails to suggest a solution to the problem of providing a developer composition which avoids use of both a developer and pH control agent each of which exhibit certain toxic characteristics.

For instance, U.S. Pat. No. 3,942,985, while focusing upon the use of ascorbic acid and certain of its derivatives in a developer composition, still suggests the use of caustic soda (sodium hydroxide) as a pH control agent. The composition of the patent also requires the use of an iron chelate (ferric sulfate plus ethylene diamine tetraaceticacid).

Applicant has surprisingly and unexpectedly found, however, that a developer composition which employs ascorbic acid and sugar-type derivatives thereof, stereoisomers and diastereoisomers of ascorbic acid and its sugar-type derivatives, their salts and mixtures thereof may be successfully employed as the developing agent in a developer composition without the need of any caustic alkalies as pH control agents.

To those skilled in the art, it is also known that the addition of sodium sulfate and/or glutaraldehyde to a developer used at ambient temperatures in excess of 90° F. prevents excessive swelling of the emulsion during development (see, Photographic Processing Chemistry, L. F. A. Mason, 1966, p. 211; and Developing, C. I. and R. E. Jacobson, p. 229).

The application of this knowledge to the related need to control swelling during development in an automatic film processor with a developer temperature of 90° to 95° F. has surprisingly resulted in a reduction in swelling sufficient to thoroughly dry both exposed and unexposed radiographic films and to process them without scratches resulting from automatic film processing.

The developer composition described herein may also contain a multitude of conventional additives which serve various functions, such as additional developing agents, anti-fogging agents, development restrainers, alkali buffers, anti-oxidant preservatives, development accelerators, sequestering agents, swelling control agents and wetting agents, the use of which are well known.

For example, the use of organic anti-fogging agents such as benzotriazole, 1-phenyl-5-mercapto-tetrazole and 5-nitrobenzotriazole and restrainers such as the soluble halides, sodium or potassium bromide may be safely used in this invention to retard the development of non-exposed silver halide and to decrease the occurrence of fog (i.e., the production of silver formed by development of non-exposed silver halide).

More specifically, exemplary organic antifogging agents include but are not limited to derivatives of benzimidazole, benzotriazole, tetrazole, imidazole, indazole, thiazole, and mercaptotetrazole used alone or in admixture.

The additional presence of a 3-pyrazolidone developing agent (or derivative thereof) results in a synergistic effect upon the speed of development of the developer composition. That is, such compounds enhance the rate by which image density is achieved over a given period of time at a specific temperature.

Among the 3-pyrazolidone developing agents which may be useful in the developer composition of the present invention are those of the formula:

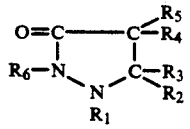

in which $R_1$ can be an alkyl group containing 1 to 12 carbon atoms, benzothiazolyl or an aryl group of the benzene or naphthalene series, substituted or not; $R_2$, $R_3$, $R_4$ and $R_5$ can be hydrogen, alkyl groups containing 1 to 12 carbon atoms, or aryl groups such as phenyl and napthyl, substituted or not; and $R_6$ can be hydrogen, an alkyl group, an acyl group or an aryl group; as well as salts thereof.

Typical 3-pyrazolidone compounds which may be employed include but are not limited to 4-(hydroxymethyl)-4-methyl-1-phenyl-3-pyrazolidone, 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, 1-p-chlorophenyl-3-pyrazolidone, 5-phenyl-3-pyrazolidone, 1-phenyl-5-methyl-3-pyrazolidone, 1-m-tolyl-3-pyrazolidone, 1-p-methoxyphenyl-3-pyrazolidone, etc. Additional representative examples of suitable 3-pyrazolidone compounds are disclosed in U.S. Pat. Nos. 2,688,549, 3,865,591 and 4,269,929, each herein incorporated by reference. Alkali buffers such as sodium and potassium carbonates and bicarbonates may be safely used. Anti-oxidant preservatives such as the alkali metal sulfites and bisulfites, (e.g. sodium and potassium sulfites and metabisulfites) are normally present in a hydroquinone-type developer to limit oxidation of the developing agents. They are normally employed in a ratio of 2 to 3 times the weight of hydroquinone, but in the present invention are reduced to from 10% to 100% of the weight of the ascorbic acid, salt, or isomer or its salts and function additionally as development accelerators (see, The Superadditivity of Hydroquinone-Phenidone Developers. VII. The Influence of the Concentrations of Hydroquinone, Phenidone, and Sodium Sulfite, G. F. VanVeelen, Photographic Science and Engineering, Vol. 13, No. 1, Jan.-Feb. 1969).

Small amounts of sequestering agents (or chelating agents) are also generally employed to sequester trace metal ions (such as copper, iron and magnesium ions) which may otherwise interfere with the solubility of the solid components in water or enhance the auto-oxidation rates of the developing agents. Exemplary sequestering agents include but are not limited to aminopolycarboxylic acid compounds, ethylenediaminetetraacetic acid (EDTA) and sodium salts thereof, diethylenetriaminopentaacetic acid (DPTA), diaminopropanoltetraacetic acid (DPTA), gluconic acid and its salts, hepto and boro-gluconates, citric acid and its salts, etc. Suitable sequestering agents are known to those skilled in the art and need not be discussed in further detail.

COMPARATIVE EXAMPLE

The following is an example of a prior art developer composition which employs hydroquinone, caustic alkali, and glutaraldehyde, which may be successfully replaced by the novel developer compositions of the present invention (source: SPSE Handbook, pp. 569–570):

| | | |
|---|---|---|
| Sodium sulfite | 60.0 | gms. |
| Sodium hydroxide | 19.0 | |
| $Na_4EDTA$ | 3.5 | |
| 1-phenyl-3-pyrazolidone | 0.75 | |
| 5-nitrobenzimidazole | 0.5 | |
| Hydroquinone | 24.0 | |
| Sodium metaborate | 33.0 | |
| Sodium glutaraldehyde bisulfite | 17.0 | |
| Potassium bromide | 10.0 | |
| Water to 1.0 liter | | |
| pH = 10.0–10.3 | | |

EXAMPLE 1

The following is an example of a developer composition prepared according to the present invention which desirably avoids the presence of hydroquinone and caustic alkalies and is formulated for use in roller transport processors:

| | | |
|---|---|---|
| Sodium sulfite | 8.0 | gms. |
| $Na_4EDTA$ | 0.65 | |
| Benzotriazole | 0.14 | |
| 4-(hydroxymethyl)-4-methyl-1-phenyl-3-pyrazolidone | 1.0 | |
| Sodium erythorbate | 50.0 | |
| Potassium carbonate | 25.0 | |
| Sodium sulfate | 50.0 | |
| Sodium bromide | 1.0 | |
| Water to 1.0 liter | | |
| pH = 10.0–10.4 | | |

Fully exposed sheets of radiographic film, size 14×17, with an emulsion on both sides, made by the DuPont Co., called Cronex 7, were processed (using the developer composition of Example 1) in a 14" wide processor made by The Cordell Co. of Boston, Mass., at a temperature of 90° F. The density obtained was the maximum for this type of film (approx. 3.60), the film was dry and exhibited no scratches. Totally unexposed sheets of the same film were processed with a base density of 0.06. They exited the processor with no scratches and were completely dry. This processor is of a newer "straight-through" design, without traditional guides to carry the film over from one processing tank to the next.

A similar test was conducted in a processor manufactured by Fischer Industries of Geneva, Illinois, called the Model E. This processor is of conventional design with processing tanks of approximately 2.5 gal. capacity, stainless steel carryover guides between tanks, and 2 dryers for both surfaces of the film. Both exposed and unexposed samples yielded densities similar to the above, were dry, and had no scratches on the emulsion.

The developer compositions of the present invention may also be prepared in the form of a single solid mixture (powder form) of various components such as developing agents, anti-foggants, preservatives, alkalies, etc., with the developer composition being converted for use by being added to the requisite amount of water and being dissolved therein in proportions consistent with the teachings of the present invention. This is an advantage over the present radiographic developers for automatic processors which are normally prepared as three liquid concentrates, which contain separately, the hydroquinone, the glutaraldehyde and the second developing agent. The single powder mixture is less expensive to ship due to no water in it; is easier to mix since it is in one part rather than three parts and is easier to store, requiring less storage space.

The composition of the present invention is alkaline by nature to permit its successful use as a developer. The pH of the developer composition in aqueous solution should be preferably within the range of from about 9.5 to 10.6, and preferably in the range of about 9.5 to 10.5. At pH's in excess of about 10.6 the developer composition is subject to degradation, while at pH's below about 9.5, the developer composition exhibits some reduction in activity.

The alkalinity of the composition may be maintained within the desired range by the presence of an alkali metal carbonate, such as sodium or potassium carbonate either singly or in combination with alkali metal bicarbonates such as sodium or potassium bicarbonate. Sufficient quantities should be present to ensure maintenance of the solution pH within the desired range.

A preservative such as sodium or potassium sulfite or metabisulfite is normally present in a developer composition. In the present invention this also serves as a development accelerator. It has also been determined that the quantity of sulfite present is only 10% to 50% of that normally required in hydroquinone-type developer compositions. It is reasoned that this significantly lower sulfite requirement is due to the capability of the developing agents to withstand oxidation with a lesser amount of preservative than is the case when hydroquinone is present.

Obviously, the fact that the solution pH is significantly alkaline and an alkali metal carbonate is present, results in the transformation of any ascorbic or erythorbic acid present to the corresponding salt upon formation of an aqueous solution of the developer.

As a result, the developer composition of the present invention may, by way of example, be comprised (based on 1.0 liter of aqueous composition) of the above components within the following ranges:

| Component | Grams/liter |
|---|---|
| Alkali sulfite | 2 to 50 |
| Sequestering agent (e.g., $Na_4EDTA$) | 1 to 3 |
| Benzotriazole | .05 to 1 |
| 3-pyrazolidone compound | .75 to 4 |
| Ascorbic acid-based developer | 15 to 80 |
| Alkali metal carbonate | 20 to 30 |
| Sodium sulfate | 35 to 90 |
| Glutaraldehyde | 5 to 15 |
| Sodium bromide | 1 to 10 |

The above exemplary ranges for various specific compounds which may be employed with success in the developer composition of the present invention may be modified taking into account differences such as molecular weight in related derivatives of such compounds (such as the use of sodium versus potassium carbonates and sulfites). Such modification of the above ranges is well within the ability of one skilled in the art.

With regard to the use of the developer composition of the present invention, the time and temperature employed during the development step can vary widely. For instance, the developer temperature can range from about 20° to about 50° C. while the development time can vary from about 5 to 200 seconds and preferably from 5 to 45 seconds.

After development, the silver halide material is fixed, washed, and dried in a conventional manner.

What is claimed is:

1. A non-hydroquinone and non-alkali metal hydroxide containing developer composition for radiographic materials comprising a developer selected from the group consisting of ascorbic acid and sugar-type derivatives thereof, stereoisomers and diastereoisomers of ascorbic acid and its sugar-type derivatives, their salts and mixtures thereof, together with a sulfite, a 3-pyrazolidone compound, and an anti-swelling agent selected from the group consisting of sodium sulfate, glutaraldehyde or mixtures thereof, said composition having a pH of from 9.5 to 10.6, said developer being present in an amount of at least about 15 grams, said sulfite being present in an amount of from 2 to 50 grams, said swelling control agent being present in an amount of from 35 to 90 grams, and water to 1.0 liter.

2. The developer composition of claim 1 wherein said developer is selected from the group consisting of ascorbic acid, erythroascorbic acid, 1-glucosascorbic acid, 1-rhamnoascorbic acid, 1-fucoascorbic acid, d-glucoheptoascorbic acid, sorboascorbic acid, ω-lactoascorbic acid, maltoascorbic acid, 1-araboascorbic acid, 1-glucoascorbic acid, d-galactoascorbic acid, 1-guloascorbic acid, and 1-alloascorbic acid.

3. The developer composition of claim 1 wherein said developer comprises an alkaline metal salt.

4. The developer composition of claim 1 wherein said developer is selected from the group consisting of ascorbic and erythorbic acids and salts thereof.

5. The developer composition of claim 4 wherein said developer is selected from the group consisting of (1) ascorbic acid or erythorbic acid, either singly or in admixture, together with at least one salt thereof, and (2) at least one salt of ascorbic or erythorbic acid.

6. The photographic developer of claim 1 wherein said developer is potassium erythorbate.

7. The photographic developer of claim 1 wherein said developer is sodium erythorbate.

8. The photographic developer of claim 1 wherein said developer is a mixture of sodium erythorbate and erythorbic acid.

9. The photographic developer of claim 1 further comprising a component selected from the group consisting of a sequestering agent, an anti-fogging agent, and mixtures thereof.

10. The photographic developer of claim 1 wherein said sulfite is selected from the group consisting of sodium and potassium sulfite.

11. The photographic developer composition of claim 1 further comprising a sequestering agent.

12. The photographic developer composition of claim 1 wherein said anti-swelling agent comprises sodium sulfate.

13. The photographic developer composition of claim 1 wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

14. The photographic developer composition of claim 1 wherein said developer composition comprises 4-(hydroxymethyl)-4-methyl-1-phenyl-3-pyrazolidone, benzotriazole, 1-phenyl-5-mercaptotetrazole, potassium carbonate, sodium bromide, and sodium sulfite.

15. The photographic developer composition of claim 11 comprising $Na_4EDTA$.

16. The photographic developer composition of claim 1 wherein said developer has the formula

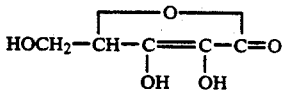

17. The photographic developer composition of claim 1 wherein said developer has the formula

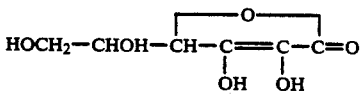

18. A method of effecting development of an imagewise exposed radiographic material comprising effecting development of said material while in contact with a non-hydroquinone and non-alkali metal hydroxide containing aqueous development medium comprising a developer selected from the group consisting of ascorbic acid and sugar-type derivatives thereof, stereoisomers and diastereoisomers of ascorbic acid and its sugar-type derivatives, their salts and mixtures thereof, together with a sulfite, a 3-pyrazolidone compound and an anti-swelling agent selected from the group consisting of sodium sulfate and glutaraldehyde, said composition having a pH of from 9.50 to 10.6, said developer being present in an amount of at least about 15 grams, said sulfite being present in an amount of from 2 to 50 grams, said swelling control agent being present in an amount of from 35 to 90 grams, and water to 1.0 liter.

19. The method of claim 18 wherein said developer is selected from the group consisting of ascorbic acid, erythroascorbic acid, 1-glucosascorbic acid, 1-rhamnoascorbic acid, 1-fucoascorbic acid, d-glucoheptoascorbic acid, sorboascorbic acid, ω-lactoascorbic acid, maltoascorbic acid, 1-araboascorbic acid, 1-glucoascorbic acid, d-galactoascorbic acid, 1-guloascorbic acid, and 1-alloascorbic acid.

20. The method of claim 18 wherein said developer comprises an alkaline metal salt.

21. The method of claim 18 wherein said developer is selected from the group consisting of ascorbic and erythorbic acids and salts thereof.

22. The method of claim 21 wherein said developer is selected from the group consisting of (1) ascorbic acid or erythorbic acid, either singly or in admixture, together with at least one salt thereof, and (2) at least one salt of ascorbic or erythorbic acid.

23. The method of claim 18 wherein said developer is potassium erythorbate.

24. The method of claim 18 wherein said developer is sodium erythorbate.

25. The method of claim 18 wherein said developer is a mixture of sodium erythorbate and erythorbic acid.

26. The method of claim 18 further comprising a component selected from the group consisting of a sequestering agent, an anti-fogging agent, and mixtures thereof.

27. The method of claim 18 wherein said sulfite is selected from the group consisting of sodium and potassium sulfite.

28. The method claim 18 further comprising a sequestering agent.

29. The method of claim 18 wherein said anti-swelling agent comprises sodium sulfate.

30. The method of claim 18 wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

31. The method of claim 18 wherein said developer composition comprises 4-(hydroxymethyl)-4-methyl-1-phenyl-3-pyrazolidone, benzotriazole, 1-phenyl-5-mercaptotetrazole, potassium carbonate, and sodium bromide, and sodium sulfite.

* * * * *